United States Patent [19]

Watanabe et al.

[11] Patent Number: 4,956,258

[45] Date of Patent: Sep. 11, 1990

[54] DRY TONER FOR DEVELOPING LATENT ELECTROSTATIC IMAGES WITH IMPROVED RESISTANCE TO TONER STAINING OF VINYL CHLORIDE PRODUCTS

[75] Inventors: Yoichiro Watanabe, Fuji; Tetsuo Isoda; Mitsuo Aoki, both of Numazu, all of Japan

[73] Assignee: Ricoh Company, Ltd., Tokyo, Japan

[21] Appl. No.: 192,724

[22] Filed: May 11, 1988

[30] Foreign Application Priority Data

May 13, 1987 [JP] Japan ..... 62-114721

[51] Int. Cl.[5] ..... G03G 9/08; G03G 9/10

[52] U.S. Cl. ..... 430/109; 430/903; 430/904

[58] Field of Search ..... 430/109, 904, 903; 526/329.2

[56] References Cited

U.S. PATENT DOCUMENTS

| | | | |
|---|---|---|---|
| 4,308,354 | 12/1981 | Jung et al. | 525/84 |
| 4,657,838 | 4/1987 | Fukumoto et al. | 430/109 X |
| 4,663,263 | 5/1987 | Ikeda et al. | 430/110 |
| 4,737,432 | 4/1988 | Tanaka et al. | 430/110 |

*Primary Examiner*—Marion C. McCamish
*Assistant Examiner*—Jeffrey A. Lindeman
*Attorney, Agent, or Firm*—Cooper & Dunham

[57] ABSTRACT

A toner for developing latent electrostatic images is disclosed, which comprises a binder resin comprising a component selected from the group consisting of: (1) a mixture of the ternary copolymers of styrene, methyl acrylate, and ethyl acrylate, (2) a mixture of the binary copolymers of two monomers from among the monomers of styrene, methyl acrylate, and ethyl acrylate and homopolymers containing the remaining monomer or the copolymers of that monomer and the other monomers, and (3) a mixture of the respective homopolymers.

3 Claims, No Drawings

DRY TONER FOR DEVELOPING LATENT ELECTROSTATIC IMAGES WITH IMPROVED RESISTANCE TO TONER STAINING OF VINYL CHLORIDE PRODUCTS

BACKGROUND OF THE INVENTION

The present invention relates to a dry toner for developing latent electrostatic images used in electrophotography, electrostatic recording, and electrostatic printing, and particularly to a toner with improved resistance to toner staining of vinyl chloride products.

As conventional technology for improving the toner staining on vinyl chloride products, in Japanese Laid-Open Patent Application No. 59-162564 there is disclosed the use of a homopolymer or copolymer of (meta)acrylic ester having an alkyl group with three or less carbon atoms, or a copolymer of styrene and (meta)acrylic ester (styrene monomer units 30 wt.% or less). However, when acrylic ester is used, if the amount of styrene is 30 wt.% or less, the glass transition temperature (Tg) of the copolymer is low and the toner will probably cake during storage. When methacrylic ester is used, because the Tg is high, the storage characteristics of the toner are good, but it has a drawback inasmuch as it is impossible to obtain adequate image fixing performance.

In addition, in Japanese Laid-Open Patent Application No. 59-166965, there is disclosed the use of a polymer containing 20 wt.% to 50 wt.% of at least one compound selected from the group consisting of hydroxyalkyl methacrylate, hydroxyalkyl acrylate, methacrylic acid, acrylic acid, glycidyl methacrylate, glycidyl acrylate, methacrylonitrile, and acrylonitrile, with a glass transition temperature of 50° to 80° C. By the introduction of a polar group into a binder resin, the resistance to toner staining of vinyl chloride products is improved, but there is some water absorption so that the electrostatic charge environmental stability becomes unsatisfactory.

There is generally an improvement in the resistance to toner staining of vinyl chloride products as a result of the extremely high increase in the crosslinking density of the binder resin, but the image fixing performance becomes unsatisfactory. In addition, resins with a solubility parameter which is far from that of a vinyl chloride plasticizer will be acceptable, but there are various inconveniences. For example, polyester has a strongly negative polarity which makes it difficult to use with a positive toner.

SUMMARY OF THE INVENTION

It is therefore an object of the present invention to provide, with due consideration to the drawbacks of such conventional materials, a toner with improved resistance to toner staining of vinyl chloride products, wherein the basic toner characteristics of conventional products, such as the electrostatic charge characteristics, image fixing performance, and storage stability are maintained unchanged.

The object of the present invention is achieved by a toner for developing latent electrostatic images wherein the binder resin comprises a mixture of the ternary copolymers of styrene, methyl acrylate, and ethyl acrylate; or a mixture of the binary copolymers of two monomers from among the monomers of styrene, methyl acrylate, and ethyl acrylate and homopolymers containing the remaining monomer or the copolymers of that monomer and the other monomers; or a mixture of the respective homopolymers.

DETAILED DESCRIPTION OF THE PREFERRED EMBODIMENTS

The toner of the present invention provides an improvement in resistance to toner staining of vinyl chloride products, while, at the same time, it has good image fixing performance and stable storage characteristics, and shows a stabilized charge quantity with respect to an environment with changing temperature and humidity. It also adequately satisfies the basic characteristics required of conventional toners.

In addition, by selection of a charge control agent, both positively and negatively charged toners can be provided. The glass transition temperature (Tg) of the above-mentioned binder resin is in the range of 50° C. to 70° C. By the inclusion of a methyl acrylate component at 50 wt.% or more of the ethyl acrylate component, the resistance to toner staining of vinyl chloride products, image fixing performance, and storage stability can be significantly improved.

Toner staining of vinyl chloride products is caused by the shift of a plasticizer such as dioctyl phthalate (DOP) and dibutyl phthalate (DBP) contained in a soft polyvinyl chloride to the toner, which causes the viscosity of the toner to decrease so that the toner adheres to the vinyl chloride products.

This type of toner not only stains vinyl chloride products, but by staining copy paper it can also contribute to the disappearance of the copied data, so that there is a strong demand for an improved toner. Generally, a styrene-acryl type copolymer is widely used as a superior binder resin for toners, but with this material the toner easily adheres to soft vinyl chloride products and causes ready staining. The reason for this is that the solubility parameter (Sp value) of styrene is so close to that of a vinyl chloride plasticizer that their compatibility is good.

When the methyl acrylate and ethyl acrylate used in the present invention are copolymerized with styrene, the resistance to staining of polyvinyl chloride products is also very good. This effect is especially remarkable with the methyl acrylate.

However, when a resin which comprises only styrene and methyl acrylate is used, the toner has a rather high fixing temperature, so that by adding ethyl acrylate the image fixing performance is improved. Furthermore, it is possible to have a toner with improved resistance to staining of polyvinyl chloride products.

When the methyl acrylate component is used at a ratio of ½ or more by weight of the ethyl acrylate component, the resistance to staining of polyvinyl chloride products is greatly improved.

The homopolymers of styrene, methyl acrylate, and ethyl acrylate have good compatibility so that the Tg of their mixtures and copolymers is almost an average Tg at the proportions of the blended weights of the respective homopolymers.

The Tgs of the respective homopolymers also depend on the molecular weights. For polystyrene the Tg is about 100° C., for polymethyl acrylate about 10° C., and for polyethyl acrylate about − 24° C.

At a Tg of 70° C. or more, the amount of styrene becomes large, so that the resistance to staining of polyvinyl chloride products tends to be unsatisfactory. In addition the image fixing performance is also inadequate.

At a Tg of 50° C. or less, the resistance to staining of polyvinyl chloride products and image fixing performance are good, but the storage stability of the toner becomes inadequate, and the toner shows a tendency to cake during storage.

To mix styrene, methyl acrylate, and ethyl acrylate, any method of mixing their respective homopolymers, or of mixing the binary polymers and ternary polymers is acceptable. When preparing a toner, if a coloring agent is added, followed by kneading and dissolving, a method by which binary and ternary polymers containing styrene are mixed gives good dispersibility.

When polymerizable toner particles are prepared with addition of a colorant at the polymerization, monomers may be mixed or a polymer may be dissolved in a monomer solution, followed by polymerization thereof.

In addition, the molecular weights may be adjusted arbitrarily so as to match to the image fixing performance of the object material. Further, in the present invention the Tg was measured by means of a differential scanning calorimeter.

The following types of pigments and dyes may be employed as coloring agents for use in the toner of the present invention.

BLACK PIGMENT

Carbon black, acetylene black, lamp black, and Aniline Black.

YELLOW PIGMENT

Chrome yellow, zinc yellow, cadmium yellow, yellow iron oxide, Mineral Fast Yellow, Nickel Titanium Yellow, Navel Yellow, Naphthol Yellow S, Hansa Yellow G, Hansa Yellow 10G, Benzidine Yellow G, Benzidine Yellow GR, Quinoline Yellow Lake, Permanent Yellow CG, and Tartrazine Yellow Lake.

ORANGE PIGMENT

Chrome orange, molybdenum orange, Permanent Orange GTR, Pyrazolone Orange, Vulcan Orange, Indanthrene Brilliant Orange RK, Benzidine Orange G, and Indanthrene Brilliant Orange GK.

RED PIGMENT

Red iron oxide, cadmium red, red lead, cadmium mercury sulfide, Permanent Red 4R, Lithol Red, Pyrazolone Red, Watchung Red Calcium Salt, Lake Red D, Brilliant Carmine 6B, Rhodamine B Lake, Alizarine Lake, Brilliant Carmine 3B.

VIOLET PIGMENT

Manganese violet, Fast Violet B, and Methyl Violet Lake.

BLUE PIGMENT

Prussian blue, cobalt blue, Alkali Blue Lake, Victoria Blue Lake, Phthalocyanine Blue, Metal-Free Phthalocyanine Blue, partially chlorinated compounds, Fast Sky Blue, and Indenthrene Blue BC.

GREEN PIGMENT

Chrome green, chromium oxide, Pigment Green B, Malachite Green Lake, and Fanal Yellow Green.

WHITE PIGMENT

Zinc flower, titanium oxide, antimony white, and zinc sulfide.

EXTENDER PIGMENT

Barite powder, barium carbonate, clay, silica, white carbon, talc, alumina white and a variety of dyes (basic, acid dispersed and other dyes) such as Nigrosine, Methylene Blue, Rose Bengale, Quinoline Yellow and Ultramarine Blue.

As the charge controlling agents for controlling the polarity and charge quantity of the toner for use in the present invention, for example, the following high polarity materials can be employed: grothine, monoazo dye, zinc hexadecyl succinate, alkyl ester or alkyl amido of naphthoic acid, nitrohumic acid, N,N'-tetramethyl diamine benzophenone, N,N'-tetramethyl benzidine, triazine and metal complexes of salicylic acid.

In the case where the toner of the present invention is used as a magnetic toner, strongly magnetic elements and their alloys or compounds may be used in the form of magnetic powders. As specific examples, conventional magnetic materials such as alloys or compounds of iron (such as magnetite, hematite, and ferrite), cobalt, nickel, manganese, and other ferromagnetic alloys are commonly used.

These magnetic materials are used in the form of fine powders with an average particle diameter of about 0.1 to 5 μm, and preferably 0.1 μm. They are added at about 1 to 60 wt.% of the toner, preferably 5 to 40 wt.%.

In the case where the toner of the present invention is used for image fixing by a heated roller, commonly known release agents are used as required to prevent toner image offset and the problem whereby a copy paper is wound around the heated roller. Specific examples of such release agents are various types of waxes, low-molecular-weight polypropylene and polyethylene. In addition, fine powders of silica, titanium oxide, alumina, silicon carbide, zinc oxide, metallic salts of the higher fatty acids, and hard resins may be added and blended to improve the fluidity and cleaning characteristics of the toner.

The present invention will now be explained with reference to the following examples. These examples are given for illustration of the invention and are not intended to be limiting thereof.

EXAMPLE 1

62 parts by weight of styrene monomer, 29 parts by weight of methyl acrylate monomer, and 9 parts by weight of ethyl acrylate monomer were blended. Benzoyl peroxide was then added to this mixture, and a polymer with a number average molecular weight of 20,000 and a weight average molecular weight of 200,000 was obtained by suspension polymerization.

Into 89 parts by weight of this polymer were blended 10 parts of carbon black and 1 part by weight of Nigrosine dye. The mixture was kneaded and fused for one hour in a two-roller mill.

After cooling, the mixture was subjected to coarse grinding in a mill, followed by fine pulverization in a jet mill. The resulting powder was classified using a pneumatic classifier so that a toner No. 1 with a volume mean diameter of 11 μm was obtained.

Measurements were made of the Tg, resistance to staining of polyvinyl chloride products, image fixing performance, image fixing temperature lower limit (the lowest temperature at which image fixing is possible), and storage stability of the toner, to evaluate the toner. The results are given in Table 1.

The following evaluation tests were made.

(1) Image sample preparation

Four parts by weight of the toner are mixed with 96 parts by weight of a carrier of oxidized iron powder (TEFV 200/300 manufactured by Nihon Teppun Co., Ltd.) and blended with agitation in a V-blender for 30 minutes to prepare a developer. Using this developer, an image sample is prepared using a commercially available electrophotographic copying machine (Trademark "FT-8030" made by Ricoh Company, Ltd.). A black toner-deposited section 10 mm×50 mm with a reflection density of 1.2 is provided on this image sample.

(2) Resistance to staining of polyvinyl chloride

The image sample obtained in (1) is sandwiched between sheets of soft vinyl chloride and a load of 1 kg per A4 size area is applied. After allowing to stand at 40° C. for 72 hours, the image sample is removed from the sheets, and the sheet is then examined for evidence of staining by the toner. When staining has occurred, the reflection density of a stained section on the sheet corresponding to the black section is measured using a Macbeth densitometer. The reflection density taken from a section on the sheet not corresponding to the black section of the image sample is subtracted from the above measurement and the resulting value is an indication of the staining of the polyvinyl chloride by the toner. The greater the staining, the larger this value, while a zero value is obtained for no staining.

(3) Image fixing temperature lower limit

Fixed images are obtained with the electrophotographic copying machine (Trademark "FT-8030" made by Ricoh Company, Ltd.) by using the developer prepared in (1) at various image fixing temperatures (the temperature of the heated roller surface). The black section of the fixed image with a reflection density of 1.2 is scoured five times with an ink eraser. The temperature at which this reflection density becomes 0.8 or greater is taken as the image fixing temperature lower limit.

The FT-8030 used was modified so that the fixing temperature could be varied in 5° C. increments.

(4) Storage stability 10 g of the toner is placed in a glass bottle and stored at a temperature of 45° C. for 72 hours. After completion of the storage period the toner is placed in a sieve with a 150-mesh screen and screened for one minute at an amplitude of 1 mm. The material remaining on the mesh is weighed and the result is expressed as a percentage of the original toner. The smaller this value, the better the storage stability.

EXAMPLE 2

Example 1 was repeated except that the formulation of the copolymer employed in Example 1 was changed as follows to prepare a copolymer, and by use of this copolymer, a toner No. 2 according to the present invention was prepared:

| | Parts by Weight |
|---|---|
| Styrene monomer | 63 |
| Methyl acrylate monomer | 22 |
| Ethyl acrylate monomer | 14 |

The molecular weight of the copolymer employed in this example was the same as that of the copolymer employed in Example 1.

EXAMPLE 3

Example 1 was repeated except that the formulation of the copolymer employed in Example 1 was changed as follows to prepare a copolymer, and by use of this copolymer, a toner No. 3 according to the present invention was prepared:

| | Parts by Weight |
|---|---|
| Styrene monomer | 67 |
| Methyl acrylate monomer | 15 |
| Ethyl acrylate monomer | 18 |

The molecular weight of the copolymer employed in this example was the same as that of the copolymer employed in Example 1.

EXAMPLE 4

Example 1 was repeated except that the formulation of the copolymer employed in Example 1 was changed as follows to prepare a copolymer, and by use of this copolymer, a toner No. 4 according to the present invention was prepared:

| | Parts by Weight |
|---|---|
| Styrene monomer | 69 |
| Methyl acrylate monomer | 9 |
| Ethyl acrylate monomer | 22 |

The molecular weight of the copolymer employed in this example was the same as that of the copolymer employed in Example 1.

EXAMPLE 5

Example 1 was repeated except that the formulation of the copolymer employed in Example 1 was changed as follows to prepare a copolymer, and by use of this copolymer, a toner No. 5 according to the present invention was prepared:

| | Parts by Weight |
|---|---|
| Styrene monomer | 51 |
| Methyl acrylate monomer | 29 |
| Ethyl acrylate monomer | 20 |

The molecular weight of the copolymer employed in this example was the same as that of the copolymer employed in Example 1.

EXAMPLE 6

Example 1 was repeated except that the formulation of the copolymer employed in Example 1 was changed as follows to prepare a copolymer, and by use of this copolymer, a toner No. 6 according to the present invention was prepared:

| | Parts by Weight |
|---|---|
| Styrene monomer | 75 |
| Methyl acrylate monomer | 15 |
| Ethyl acrylate monomer | 10 |

The molecular weight of the copolymer employed in this example was the same as that of the copolymer employed in Example 1.

EXAMPLE 7

To a mixture of 57 parts by weight of styrene monomer, and 43 parts by weight of methyl acrylate monomer, benzoyl peroxide and divinylbenzene were added. This reaction mixture was subjected to suspension polymerization, whereby a copolymer with a number average molecular weight of 20,000, and a weight average molecular weight of 300,000 was obtained.

75 parts by weight of styrene monomer and 25 parts by weight of ethyl acrylate monomer were mixed with toluene. With the addition of azobisisobutyronitrile as polymerization initiator, solution polymerization was conducted so that a styrene-ethyl acrylate copolymer was obtained. The thus obtained copolymer had a number average molecular weight of 5,000 and a weight average molecular weight of 10,000.

10 parts by weight of a carbon black and 1 part by weight of Nigrosine dye were added to a mixture of 50 parts by weight of the previously obtained styrene-methyl acrylate copolymer and 39 parts by weight of the styrene-ethyl acrylate copolymer, whereby a toner No. 7 according to the present invention was obtained by the same procedure as in Example 1.

COMPARATIVE EXAMPLE 1

67 parts by weight of styrene monomer was mixed with 33 parts by weight of n-butyl methacrylate monomer.

With addition of benzoyl peroxide to this mixture, suspension polymerization was conducted, whereby a copolymer with a number average molecular weight of 20,000 and a weight average molecular weight of 200,000 was obtained.

By use of the thus obtained copolymer, a comparative toner No. 1 was prepared by the same procedure as in Example 1.

COMPARATIVE EXAMPLE 2

78 parts by weight of styrene monomer, 11 parts by weight of 2-ethyl hexyl acrylate and 11 parts by weight of n-butyl acrylate were mixed.

With the addition of benzoyl peroxide to this mixture, suspension polymerization was conducted, whereby a copolymer with a number average molecular weight of 20,000 and a weight average molecular weight of 200,000 was obtained.

By use of the thus obtained copolymer, a comparative toner No. 2 was prepared by the same procedure as in Example 1.

Toners Nos. 1 to 7 according to the present invention and comparative toners Nos. 1 and 2 were evaluated in the same manner as Example 1. The results are shown in Tables 1 and 2.

In addition to the above evaluation, the respective toners were checked with respect to stability of a charge quantity under environmental changes (temperature and humidity). As a result, toners Nos. 1 to 7 and comparative toners Nos. 1 and 2 showed as good characteristics as those of conventional toners which compose a styrene-acrylic binder resin.

TABLE 1

| | St | MA | EA | Tg | Resistance to Staining of Polyvinyl Chloride | Image Fixing Temperature Lower Limit (°C.) | Storage Stability (%) |
|---|---|---|---|---|---|---|---|
| Example 1 | 62 | 29 | 9 | 61 | 0 | 170 | 11 |
| Example 2 | 63 | 22 | 14 | 61 | 0 | 165 | 12 |
| Example 3 | 67 | 15 | 18 | 62 | 0 | 160 | 13 |
| Example 4 | 69 | 9 | 22 | 62 | 0.23 | 155 | 12 |
| Example 5 | 51 | 29 | 20 | 47 | 0 | 140 | 68 |
| Example 6 | 75 | 15 | 10 | 71 | 0.12 | 180 | 7 |
| Example 7 | 57 | 43 | — | 63 | 0 | 160 | |
| | 75 | — | 25 | | | | |

St: Styrene monomer
MA: Methyl acrylate monomer
EA: Ethyl acrylate monomer
Tg: Glass transition temperature

TABLE 2

| | St | nBMA | 2EHA | nBA | Tg | Resistance to Staining of Polyvinyl Chloride | Image Fixing Temperature Lower Limit (°C.) | Storage Stability (°C.) |
|---|---|---|---|---|---|---|---|---|
| Comparative Example 1 | 67 | 33 | — | — | 63 | 1.18 | 160 | 13 |
| Comparative Example 2 | 78 | — | 11 | 11 | 62 | 1.31 | 160 | 12 |

St: Styrene monomer
nBMA: n-butyl methacrylate monomer
2EHA: 2-ethyl hexyl acrylate monomer
nBA: n-butyl acrylate monomer
Tg: Glass transition temperature

What is claimed is:

1. A toner for developing latent electrostatic images comprising a coloring agent and a binder resin having a glass transition temperature of 50° C. to 70° C., said binder resin comprising a component selected from the group consisting of:

(a) ternary copolymers of styrene, methyl acrylate, and ethyl acrylate monomers or mixtures thereof;

(b) mixtures of a binary copolymer and a homopolymer or copolymer wherein the monomers of the binary copolymer and the monomer of the homopolymer or monomers of the copolymer are selected from the group consisting of styrene, methyl acrylate and ethyl acrylate monomers and wherein the monomer of the homopolymer or one monomer of the copolymer is different from the monomers of the binary copolymer; and (c) mixtures of homopolymers of styrene, methyl carylate and ethyl acrylate monomers.

2. The toner for developing latent electrostatic images as claimed in claim 1, wherein the weight percentage of methyl acrylate in the binder resin is 50% or more than the weight percentage of ethyl acrylate in the binder resin.

3. A developer for developing latent electrostatic images comprising (1) a toner, and (2) carrier particles, said toner comprising a coloring agent and a binder resin having a glass transition temperature of 50° C. to 70° C., said binder resin comprising a component selected from the group consisting of:

(a) ternary copolymers of styrene, methyl acrylate, and ethyl acrylate monomers or mixtures thereof;

(b) mixtures of a binary copolymer and a homopolymer or copolymer wherein the monomers of the binary copolymer and the monomer of the homopolymer or monomers of the copolymer are selected from the group consisting of styrene, methyl acrylate and ethyl acrylate monomers and wherein the monomer of the homopolymer or one monomer of the copolymer is different from the monomers of the binary copolymer; and (c) mixtures of homopolymers of styrene, methyl acrylate and ethyl acrylate monomers.

* * * * *